US006390041B2

(12) United States Patent
Nakamura et al.

(10) Patent No.: US 6,390,041 B2
(45) Date of Patent: May 21, 2002

(54) VARIABLE-VALVE-ACTUATION APPARATUS FOR INTERNAL COMBUSTION ENGINE

(75) Inventors: Makoto Nakamura; Seinosuke Hara; Keisuke Takeda, all of Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/741,068

(22) Filed: Dec. 21, 2000

(30) Foreign Application Priority Data

Dec. 21, 1999 (JP) ..... 11-362086

(51) Int. Cl.[7] ..... F01L 13/00

(52) U.S. Cl. ..... 123/90.15; 123/90.16; 123/90.17

(58) Field of Search ..... 123/90.15, 90.16, 123/90.17, 90.31, 90.22, 90.6; 74/567, 568 R

(56) References Cited

U.S. PATENT DOCUMENTS 5,937,809 A * 8/1999 Pierik et al. ..... 123/90.16
5,988,125 A * 11/1999 Hara et al. ..... 123/90.16
6,019,076 A * 2/2000 Pierik et al. ..... 123/90.16
6,029,618 A 2/2000 Hara et al. ..... 123/90.16
6,041,746 A * 3/2000 Takemura et al. ..... 123/90.16
6,055,949 A * 5/2000 Nakamura et al. ..... 123/90.16
6,123,053 A * 9/2000 Hara et al. ..... 123/90.16

FOREIGN PATENT DOCUMENTS

JP 11-141321 5/1999

* cited by examiner

*Primary Examiner*—Weilun Lo
(74) *Attorney, Agent, or Firm*—Foley & Lardner

(57) ABSTRACT

A VVA apparatus includes an operating mechanism that changes a valve-lift amount, and a microcomputer-based controller that controls the operating mechanism to change the valve-lift amount in accordance with engine operating conditions. A first portion of the valve-lift amount between a high lift and a low lift is changed continuously, and a second portion of the valve-lift amount between the low lift and zero lift is changed with one of the low lift and zero lift selected.

23 Claims, 15 Drawing Sheets

VARIABLE-VALVE-ACTUATION APPARATUS FOR INTERNAL COMBUSTION ENGINE

BACKGROUND OF THE INVENTION

The present invention relates to a variable-valve-actuation (VVA) apparatus for an internal combustion engine that can vary, particularly, the lift amount of valves such as an intake valve and exhaust valve in accordance with engine operating conditions.

As disclosed in U.S. Pat. No. 6,029,618 issued Feb. 29, 2000 to Hara et al., the VVA apparatus typically comprises a crank cam arranged at the outer periphery of a driving shaft that rotates in synchronism with a crankshaft and having an axis eccentric to an axis of the driving shaft, and a valve operating (VO) cam to which torque of the crank cam is transmitted through a transmission mechanism to have a cam face coming in slide contact with the top face of a valve lifter arranged at the upper end of an intake valve for opening and closing operation thereof.

The transmission mechanism includes a rocker arm disposed above the VO cam and swingably supported to a control shaft, a crank arm having an annular base engaged with the outer peripheral surface of the crank cam and an extension rotatably connected to a first arm of the rocker arm through a pin, and a link rod having a first end rotatably connected to a second arm of the rocker arm through a pin and a second end rotatably connected to an end of the VO cam through a pin.

Moreover, fixed on the outer peripheral surface of the control shaft is a control cam having an axis eccentric to an axis of the control shaft by a predetermined amount and rotatably fitted in a support hole formed substantially in the center of the rocker arm. The control cam changes a rocking fulcrum of the rocker arm in accordance with the rotated position to change the position of contact of the cam face of the VO cam with respect to the top face of the valve lifter, carrying out variable control of the lift amount of the intake valve.

Specifically, when the engine operating conditions are in the low-rotation and low-load range, for example, in order to urge an actuator to rotate the control shaft clockwise, for example, for rotation of the control cam in the same direction, the rocking fulcrum of the rocker arm is moved to a certain position. Then, pivotal points of the rocker arm with the crank arm and link rod are moved leftward to draw up an end or cam nose of the VO cam, moving the position of contact of the VO cam with respect to the top face of the valve lifter to a base portion of the VO cam. Thus, the intake valve is controlled to have zero lift in the valve-lift characteristic, achieving the valve-stop state so called.

On the other hand, when the engine operating conditions are in the high-rotation and high-load range, the actuator rotates the control cam counterclockwise from the certain position through the control shaft, moving the rocking fulcrum of the rocker arm downward. Then, the cam nose of the VO cam is pushed downward by the link rod, etc. to move the position of contact of the VO cam with respect to the top face of the valve lifter to a lift top portion of the VO cam. Thus, the intake valve is controlled to have greater lift in the valve-lift characteristic.

Therefore, outstanding engine performance can be obtained, e.g. improvement in fuel consumption by valve stop in the engine low-rotation and low-load range and increase in engine output, etc. by improved intake-air charging efficiency in the engine high-rotation and high-load range. It is noted that an improvement in fuel consumption by valve stop is achieved by stopping actuation of the intake and exhaust valves of particular cylinders, i.e. carrying out reduced cylinder operation so called, or actuation of one of the two intake valves to produce swirl in a combustion chamber.

However, the VVA apparatus generally have dimensional errors of components produced upon manufacture thereof, which are naturally included in the respective cylinders to which the apparatus are mounted and have different magnitudes. The lift amount of the valves variably controlled by the VVA apparatus is not seriously affected by a dimensional error of the components in the region of medium lift to high lift since the engine can be in high rotation therein. It is, however, greatly affected by a dimensional error of the components in the region of low lift, particularly, very low lift since the engine can be in low rotation therein, where engine rotation is apt to vary.

Moreover, variation in the machining accuracy of components of the VVA apparatus results in variation in the lift amount of the valves, which are the greatest in the region of very low lift with respect to in the region of medium lift to high lift. Thus, during engine operation in the very low lift area, the mixture charging efficiency and gas flow conditions in the combustion chamber may be apt to vary between the cylinders, resulting in unstable engine rotation and lowered engine performance.

This causes need of enhanced machining accuracy of the components of the VVA apparatus, raising an inevitable technical challenge of increased manufacturing cost.

SUMMARY OF THE INVENTION

It is, therefore, an object of the present invention to provide a VVA apparatus for an internal combustion engine, which contributes to an improvement in the engine performance without any increase in manufacturing cost.

The present invention provides generally a variable-valve-actuation (VVA) apparatus for an internal combustion engine with valves, comprising:

an operating mechanism that changes a lift amount of the valves; and a microcomputer-based controller that controls said operating mechanism to change said lift amount in accordance with operating conditions of the engine, a first portion of said lift amount between a predetermined high value and a predetermined low value being changed continuously, a second portion of said lift amount between said predetermined low value and zero being changed with one of said predetermined low value and zero selected.

One aspect of the present invention is to provide a variable-valve-actuation (VVA) apparatus for an internal combustion engine with valves, comprising:

an operating mechanism that changes a lift amount of the valves, said operating mechanism comprising a driving shaft rotated by a crankshaft of the engine and provided with a crank cam at a outer periphery thereof, a valve operating (VO) cam coming in slide contact with a top face of a valve lifter disposed at an upper end of each valve to open and close it, a transmission mechanism connected between said crank cam and said VO cam, and an alteration mechanism for variably controlling an operation position of said transmission mechanism to change a position of contact of said VO cam with respect to said top face of said valve lifter; and a microcomputer-based controller that controls said operating mechanism to change said lift amount in accordance with operating conditions of the engine, a first portion of said lift amount between a predetermined high value and a predetermined low value being changed continuously, a second portion of said lift amount between said predetermined low value and zero being changed with one of said predetermined low value and zero selected.

The other objects and features of the present invention will become understood from the following description with reference to the accompanying drawings.

DETAILED DESCRIPTION OF THE INVENTION

Figure 1:
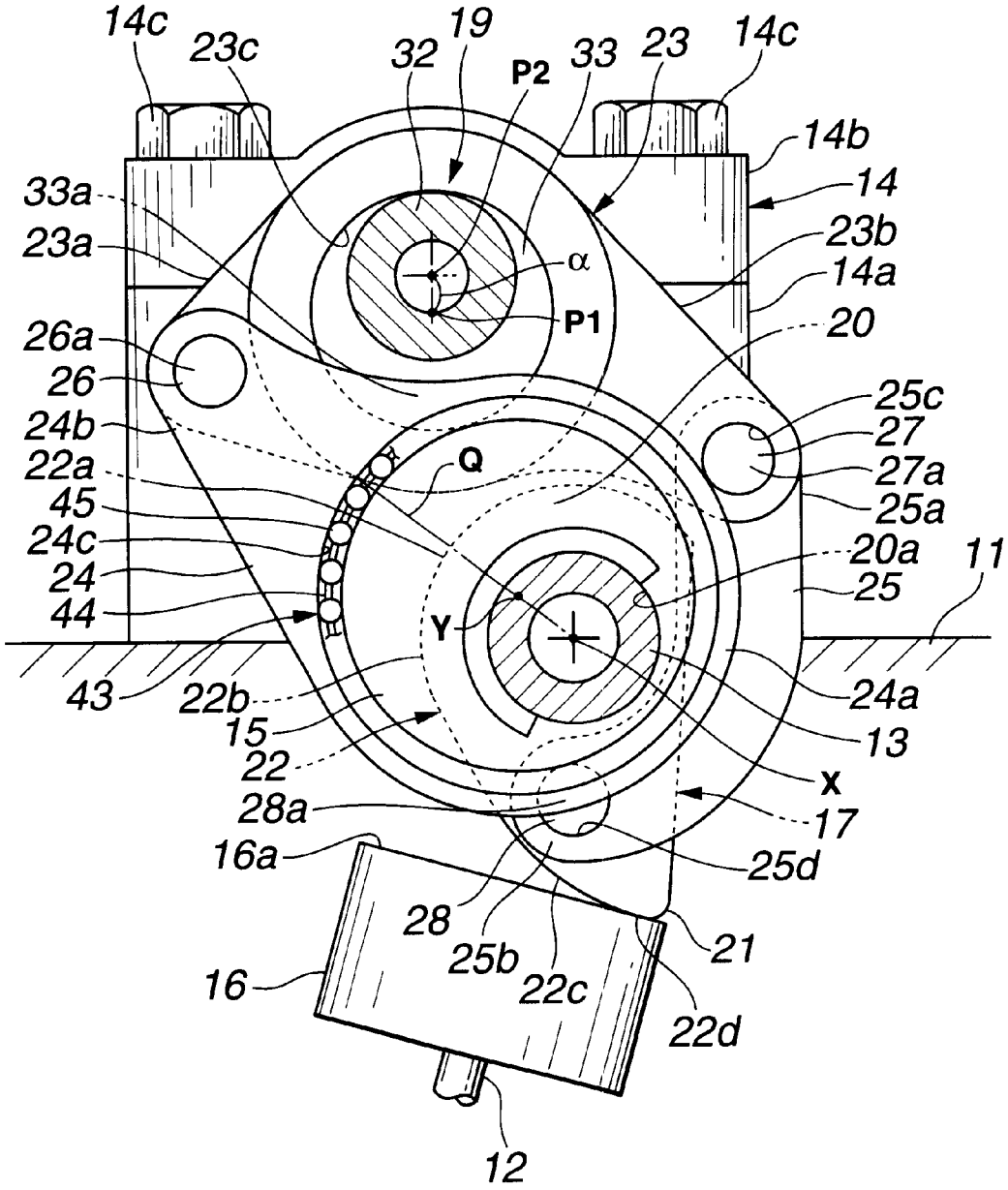
FIG. 1 is a sectional view showing a first embodiment of a VVA apparatus for an internal combustion engine according to the present invention.

Referring to the drawings, a description will be made with regard to a VVA apparatus for an internal combustion engine embodying the present invention. In embodiments of the present invention, the VVA apparatus is applied to a multiple cylinder engine with two intake valves and two exhaust valves per cylinder, and operates with two intake valves and two exhaust valves of each particular cylinder. A description is mainly provided with respect to the intake valves, since the structure is the same in the intake and exhaust valves.

Referring to FIGS. 1–4, the VVA apparatus includes an operating mechanism 10 for varying the lift amount of a pair of intake valves 12 slidably arranged with a cylinder head 11 through valve guides, not shown. The operating mechanism 10 includes a hollow driving shaft 13 rotatably supported by a bearing 14 in an upper portion of the cylinder head 11, a crank or eccentric rotating cam 15 fixed to the driving shaft 13 through a connecting pin 40, a pair of VO cams 17 swingably supported on an outer peripheral surface 13*a* of the driving shaft 13 and coming in slide contact with valve lifters 16 disposed at the upper ends of the intake valves 12 to open and close them, and transmission means 18 connected between the crank cam 15 and the VO cams 17 for transmitting torque of the crank cam 15 to the VO cams 17 as a rocking force. The transmission means 18 have an operation position variably controlled by alteration means 19.

The driving shaft 13 extends in the longitudinal direction of the engine, and has one end with a follower sprocket, a timing chain wound thereon, etc., not shown, through which torque is received from a crankshaft of the engine. The driving shaft 13 is rotated counterclockwise as viewed in FIG. 1. The driving shaft 13 is formed out of a material of high strength.

The bearing 14 includes a main bracket 14*a* arranged at the upper end of the cylinder head 11 for supporting an upper portion of the driving shaft 13, and an auxiliary bracket 14*b* arranged at the upper end of the main bracket 14*a* for rotatably supporting a control shaft 32 as will be described later. The brackets 14*a*, 14*b* are fastened together from above by a pair of bolts 14*c*.

Figure 3:
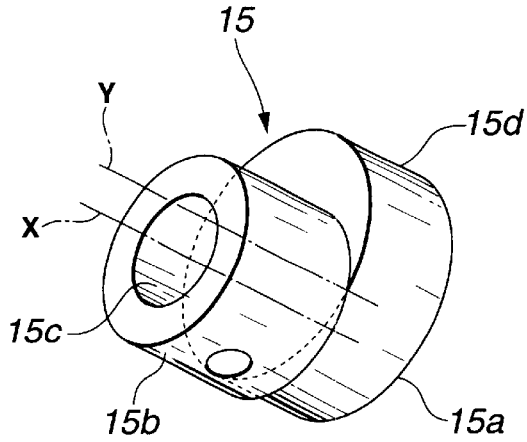
FIG. 3 is a view similar to FIG. 2, showing a crank cam.

As shown in FIG. 3, the crank cam 15, which is a unitary structure of a wear resistant material, is formed substantially like a ring, and includes an annular main body 15*a* and a cylinder 15*b* integrated with the outer end face thereof. A though hole 15*c* is formed axially through the crank cam 15 to receive the driving shaft 13. An axis Y of the main body 15*a* is offset radially with respect to an axis X of the driving shaft 13 by a predetermined amount. The crank cam 15 is engaged with the driving shaft 13 through the through hole 15*c* for mounting thereto by the connecting pin 40. A crescent flat surface is formed on one side face of the cylinder 15*b* on the side of the cam main body 15*a*. The crank cam 15 is constructed to rotate counterclockwise or in the direction of arrow as viewed in FIG. 1 with rotation of the driving shaft 13.

The valve lifters 16 are formed like a covered cylinder, each being slidably held in a hole of the cylinder head 11 and having a flat top face 16*a* with which the VO cam 17 comes in slide contact. Referring to FIG. 8B, when the valve lifter 16 is pressed to the VO cam 17 in a zero lift section, a slight valve clearance with a set value $\delta$ is held between a lower face 16*b* of the valve lifter 16 and the intake valve in consideration of a thermal expansion difference between components upon engine start, a deterioration thereof with time, etc.

Referring to FIGS. 1 and 7A–8B, the VO cam 17 is formed roughly like a raindrop, and has a support hole 20*a* at a roughly annular base end 20, through which the driving shaft 13 is arranged for rotatable support. The VO cam 17 also has a pinhole 21*a* on the side of a cam nose 21. A lower face of the VO cam 17 is formed with a cam face 22 including a base-circle face 22*a* on the side of the base end

20, a ramp face 22*b* circularly extending from the base-circle face 22*a* to the cam nose 21, and a lift face 22*c* extending from the ramp face 22*b* to a top face 22*d* with the maximum lift arranged at an end of the cam nose 21. The base-circle face 22*a,* the ramp face 22*b,* the lift face 22*c,* and the top face 22*d* come in contact with predetermined points of the top face 16*a* of the valve lifter 16 in accordance with the rocking position of the VO cam 17.

Figure 5:
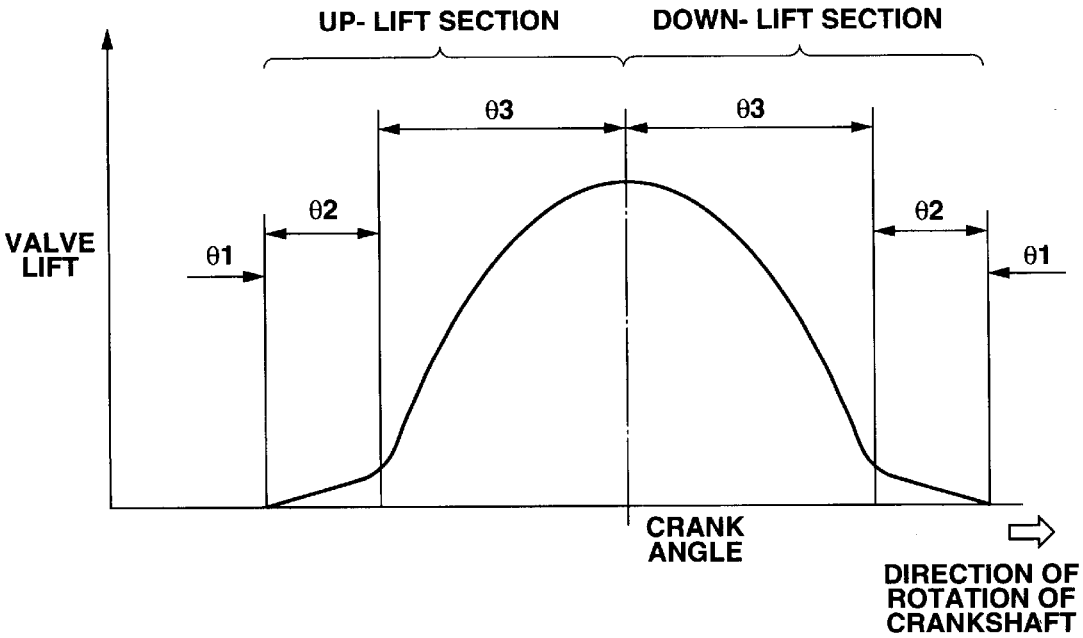
FIG. 5 is a graph illustrating the profile characteristics of a cam face of a VO cam.

Specifically, referring to FIG. 5, in view of the valve-lift characteristic, a predetermined angular range θ1 of the base-circle face 22*a* corresponds to a base-circle section, and a predetermined angular range θ2 of the ramp face 22*b* subsequent to the base-circle section θ1 corresponds to a ramp section, and a predetermined angular range θ3 of the ramp face 22*b* from the ramp section θ2 to the top face 22*d* corresponds to a lift section. As will be described later, the amount of a low lift L1 of the intake valve 12 produced by the VO cam 17 during valve-lift control is set to a predetermined value more than twice as large as the set value δ of the valve clearance.

An annular holding member 42 is arranged between one end face of the base end 20 of the VO cam 17 and the crank cam 15. The holding member 42 is of the outer diameter roughly equal to that of the cylinder 15*b* of the crank cam 15, and has a center hole 42*a* for engagement with the driving shaft 13.

The transmission means 18 include a rocker arm 23 disposed above the driving shaft 13, a crank arm 24 for linking a first arm 23*a* of the rocker arm 23 with the crank cam 15, and a link rod 25 for linking a second arm 23*b* of the rocker arm 23 with the VO cam 17.

As shown in FIG. 1, the rocker arm 23 has in the center a cylindrical base rotatably supported by a control cam 33 as will be described later through a support hole 23*c*. The first arm 23*a* protruding from an outer end of the cylindrical base has a pinhole for receiving a pin 26, whereas the second arm 23*b* protruding from an inner end of the cylindrical base has a pinhole for receiving a pin 27 for connecting the second arm 23*b* and a first end 25*a* of the link rod 25.

The crank arm 24 includes one end or relatively large-diameter annular base end 24*a* and another end or extension 24*b* arranged in a predetermined position of the outer peripheral surface of the base end 24*a*. The base end 24*a* has in the center an engagement hole 24*c* rotatably engaged with the outer peripheral surface of the main body 15*a* of the crank cam 15 through a needle bearing 43. The extension 24*b* has a pinhole for rotatably receiving the pin 26. An axis 26*a* of the pin 26 forms a pivotal point of the extension 24*b* of the crank arm 24 with the first arm 23*a* of the rocker arm 23.

As best seen in FIG. 1, the link rod 25 is formed substantially like a letter L having a concave on the side of the rocker arm 23, and has first and second ends 25*a,* 25*b* formed with pinholes 25*c,* 25*d* through which ends of the pins 27, 28 press fitted in the respective pinholes of the second arm 23*b* of the rocker arm 23 and the cam nose 21 of the VO cam 17 are rotatably arranged.

Arranged at one ends of the pins 26, 27, 28 are snap rings for restricting axial movement of the crank arm 24 and the link rod 25.

Figure 6:
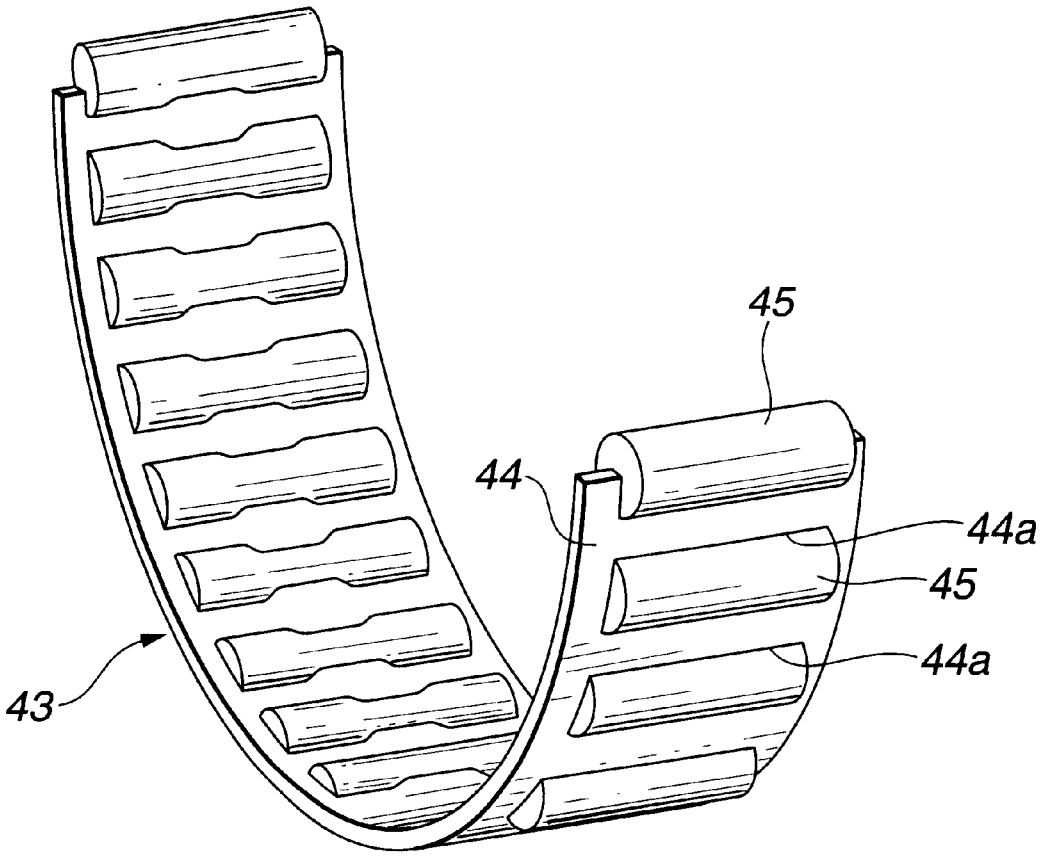
FIG. 6 is a fragmentary perspective view showing a needle bearing.

The needle bearing or ball bearing member 43 is interposed between the main body 15*a* of the crank cam 15 and the inner peripheral surface 24*c* of the base end 24*a* of the crank arm 24 engaged with an outer peripheral surface 15*d* of the cam main body 15*a*. Referring to FIG. 6, the needle bearing 43 includes an annular holder 44 and a plurality of needle rollers 45 rotatably held by the holder 44. Although FIG. 6 illustrates only about half of the needle bearing 43 for easy understanding, the actual needle bearing 43 is formed annularly.

The holder 44 is formed like an annulus ring having a plurality of rectangular openings 44*a* disposed circumferentially equidistantly. On the other hand, the needle rollers 45 are rotatably held in the respective openings 44*a* to have an inner periphery rotatably directly contacting the outer peripheral surface 15*d* of the cam main body 15*a* and an outer periphery rotatably directly contacting the inner peripheral surface 24*c* of the base end 24*a* of the crank arm 24.

Figure 4:
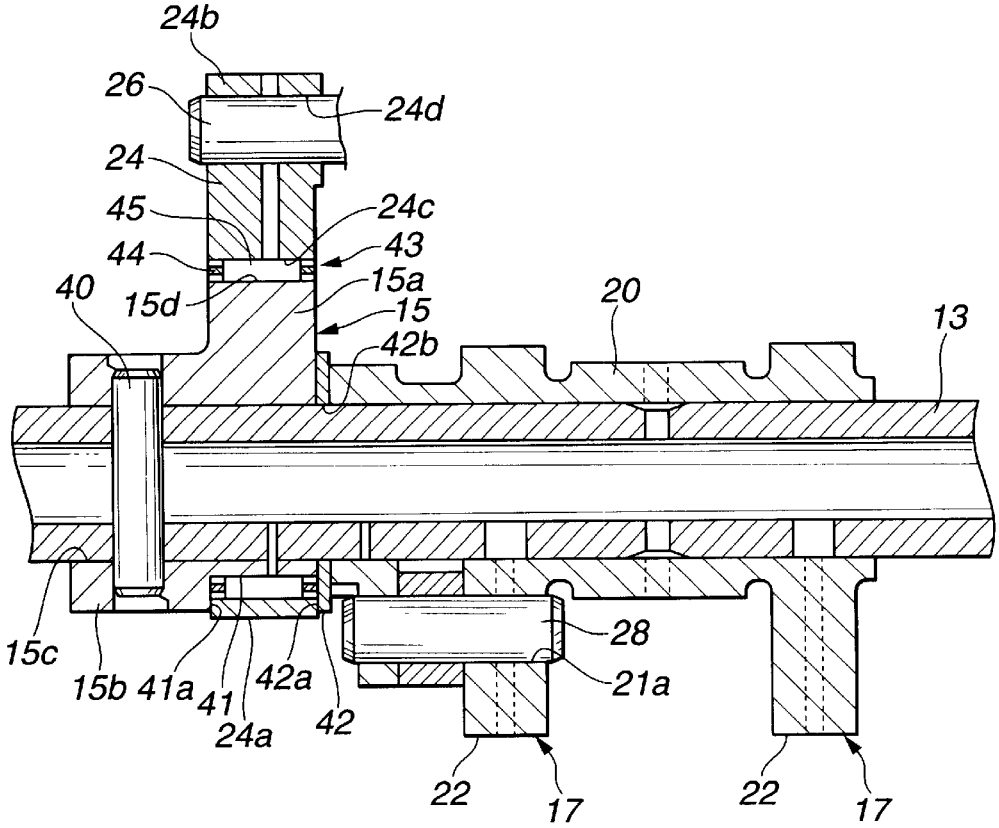
FIG. 4 is a fragmentary longitudinal section showing the VVA apparatus.

As best seen in FIG. 4, the needle bearing 43 is held in its entirety on the outer peripheral surface of the cam main body 15*a* such that both edges of the holder 44 are held by one side face 41*a* of the crank cam 15 and one side face 42*a* of the holding member 42 in the direction of the driving shaft 13. As being formed out of a wear resistant material, both the crank cam 15 and the holding member 42 achieve a restraint of wear caused by slide movement with the holder 44.

The alteration means 19 include the control shaft 32 disposed above the driving shaft 13 and rotatably supported on the bearing 14, and the control cam 33 fixed at the outer periphery of the control shaft 32 to form a rocking fulcrum of the rocker arm 23.

Figure 2:
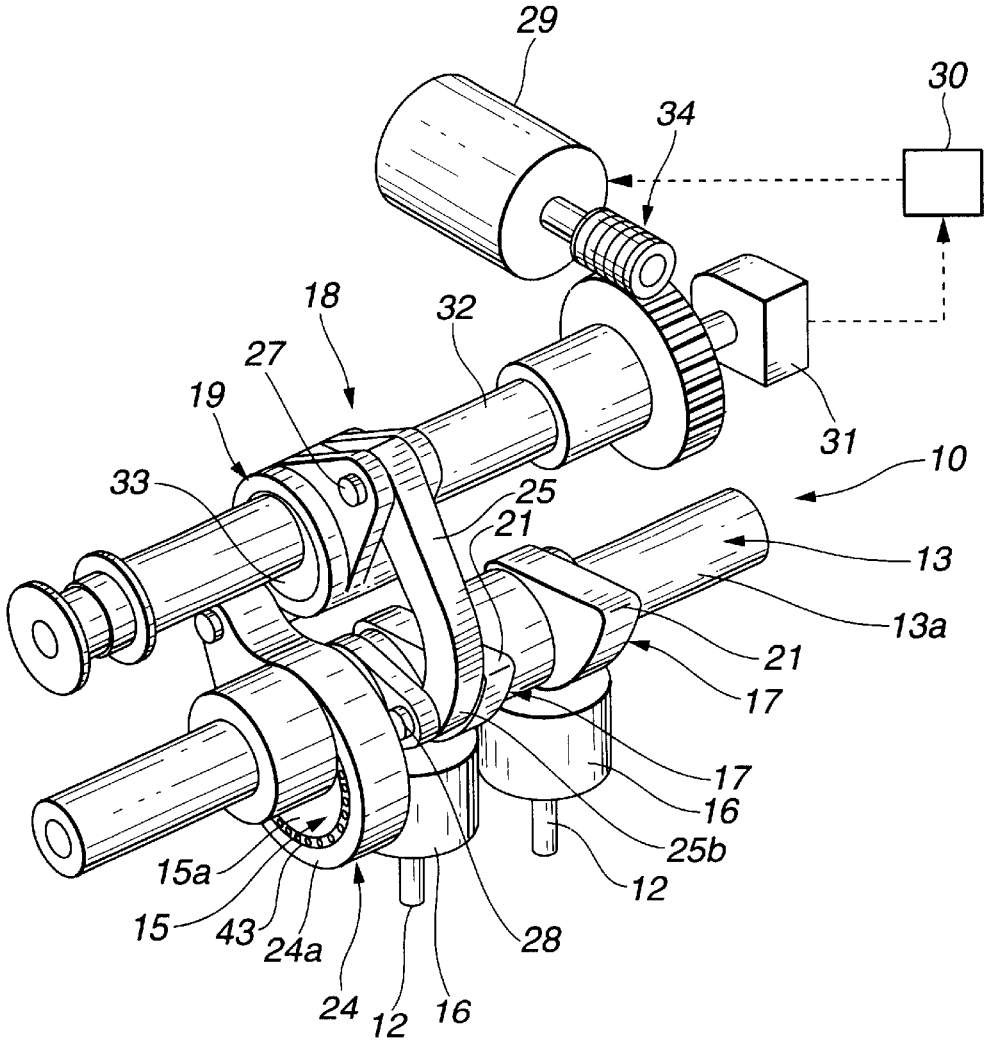
FIG. 2 is a perspective view showing the VVA apparatus.

As best seen in FIG. 2, the control shaft 32 is disposed parallel to the driving shaft 13 to extend in the longitudinal direction of the engine, and is constructed to be rotatable within a predetermined angular range by means of an electromagnetic actuator 29 arranged at one end of the control shaft 32 and a worm gear mechanism 34.

The control cam 33 is formed like a cylinder, and has an axis P1 offset with respect to an axis P2 of the control shaft 32 by an amount α corresponding to a thick portion 33*a*.

The actuator 29 for controllably rotating the control shaft 32 is driven in accordance with a control signal derived from a controller 30 for detecting engine operating conditions. The controller 30, which includes a microcomputer, serves to detect actual engine operating conditions in accordance with a signal of an engine-speed detected by a crank angle sensor and detection signals out of various sensors such as an accelerator opening-degree sensor, intake-air temperature sensor, vehicle G sensor, transmission gear-position sensor, etc. Moreover, the controller 30 provides a control signal to the actuator 29 in accordance with a detection signal out of a potentiometer 31 for detecting the rotated position of the control shaft 32 that corresponds to an actual valve lift.

Next, operation of the first embodiment will be described. When the engine is at low velocity and at low load, the control shaft 32 is rotated clockwise by the actuator 29 in accordance with a control signal out of the controller 30. Thus, the axis P1 of the control cam 33 is kept in a rotation-angle position located in the top left direction of the axis P2 of the control shaft 32 as shown in s in FIG. 7A, so that the thick portion 33*a* of the control cam 33 is moved upward with respect to the driving shaft 13. Thus, the rocker arm 23 is moved in its entirety upward with respect to the driving shaft 13, so that the VO cam 17, having the cam nose 21 forcibly slightly drawn up through the link rod 25, is rotated counterclockwise in its entirety.

Figure 7A:
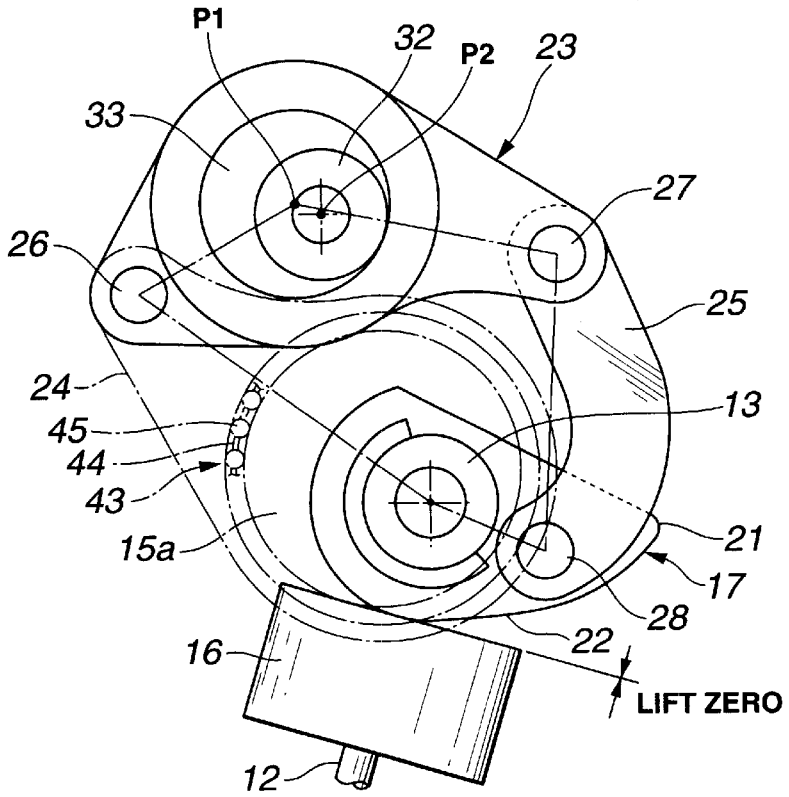
FIGS. 7A–7B are schematic drawings explaining operation of the VO cam and an intake valve when the valve has zero lift.
Figure 7B:
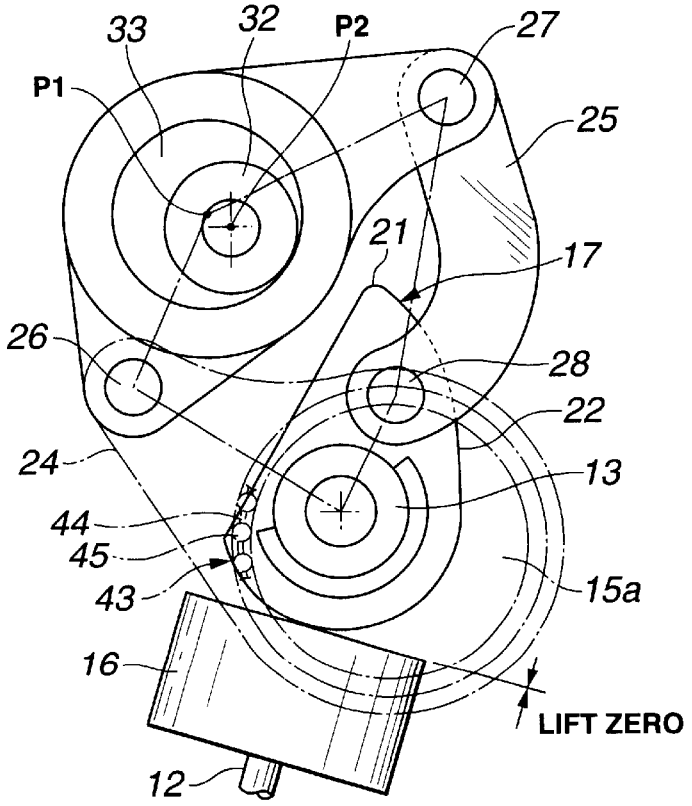

Therefore, referring to FIGS. 7A–7B, when rotation of the crank cam 15 pushes the first arm 23*a* of the rocker arm 23 upward through the crank arm 24, the corresponding lift amount, transmitted to the VO cam 17 and the valve lifter 16 through the link rod 25, is kept zero.

Figure 10:
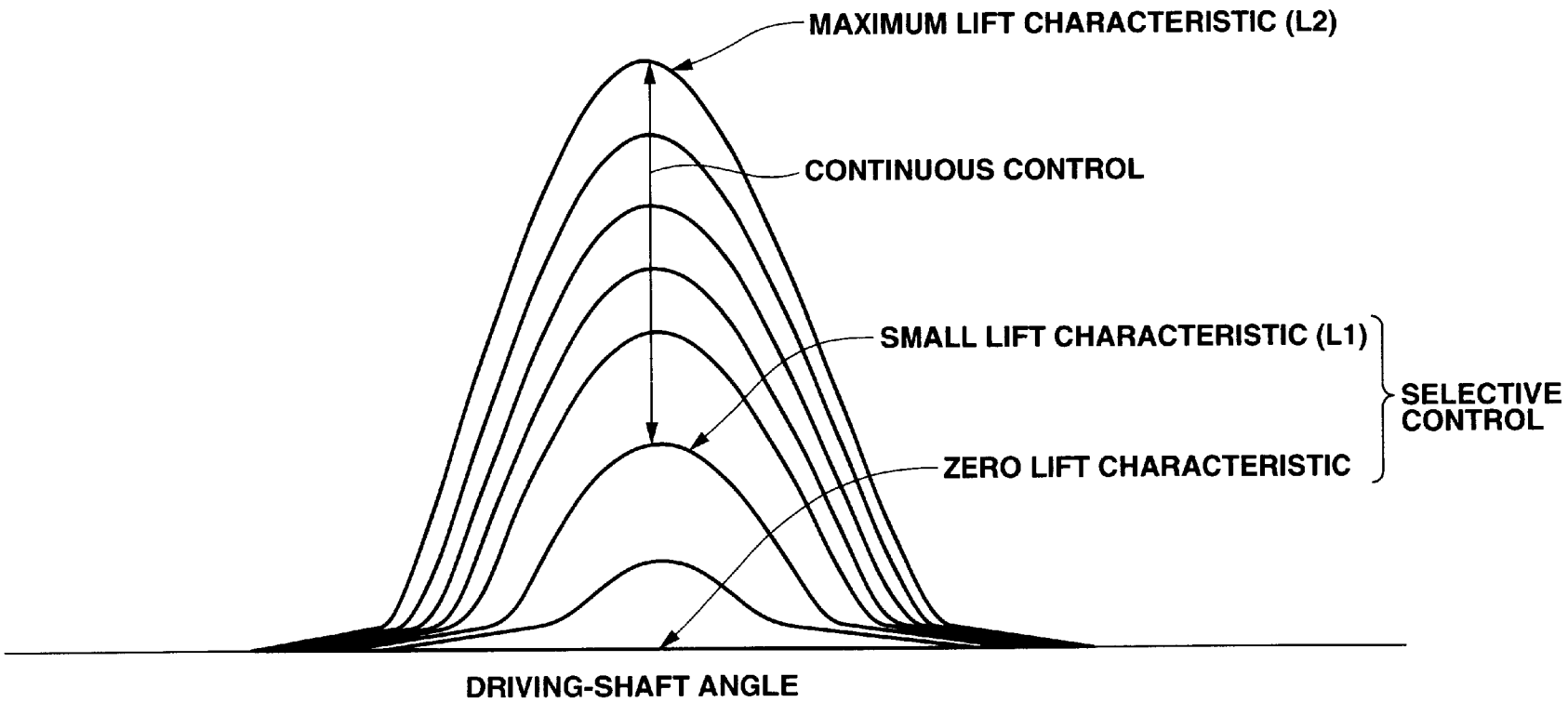
FIG. 10 is a view similar to FIG. 5, illustrating the valve-lift characteristics.

Thus, in such low-velocity and low-load range, referring to FIG. 10, the two intake valves 12 are held at zero lift, i.e. in the valve-closed state. This allows lowering of friction, etc., resulting in greatly improved fuel consumption. Moreover, in the first embodiment, so-called reduced cylinder operation is carried out wherein the two intake valves 12 of each particular cylinder are at zero lift or in the valve-stop state, and the two exhaust valves of the same cylinder are also at zero lift or in the valve-stop state, but the intake and exhaust valves of the other cylinders are not in the valve-stop state. This reduces a pumping loss, resulting in further improvement in fuel consumption.

When depressing an accelerator pedal to pass the engine operating conditions from the low-rotation and low-load range (state as shown in FIGS. 7A–7B) to the low-rotation and medium-load or medium-rotation and low-load range, the control shaft 32 is rotated slightly counterclockwise in an instant by the actuator 29 in accordance with a control signal out of the controller 30. Thus, referring to FIGS. 8A–8B, this rotates the control cam 33 slightly counterclockwise in an instant from the position as shown in FIGS. 7A–7B to slightly move the axis P1 of the control cam 33 in an instant. As a result, the valve-lift amount passes from zero to L1 in an instant.

Figure 11:
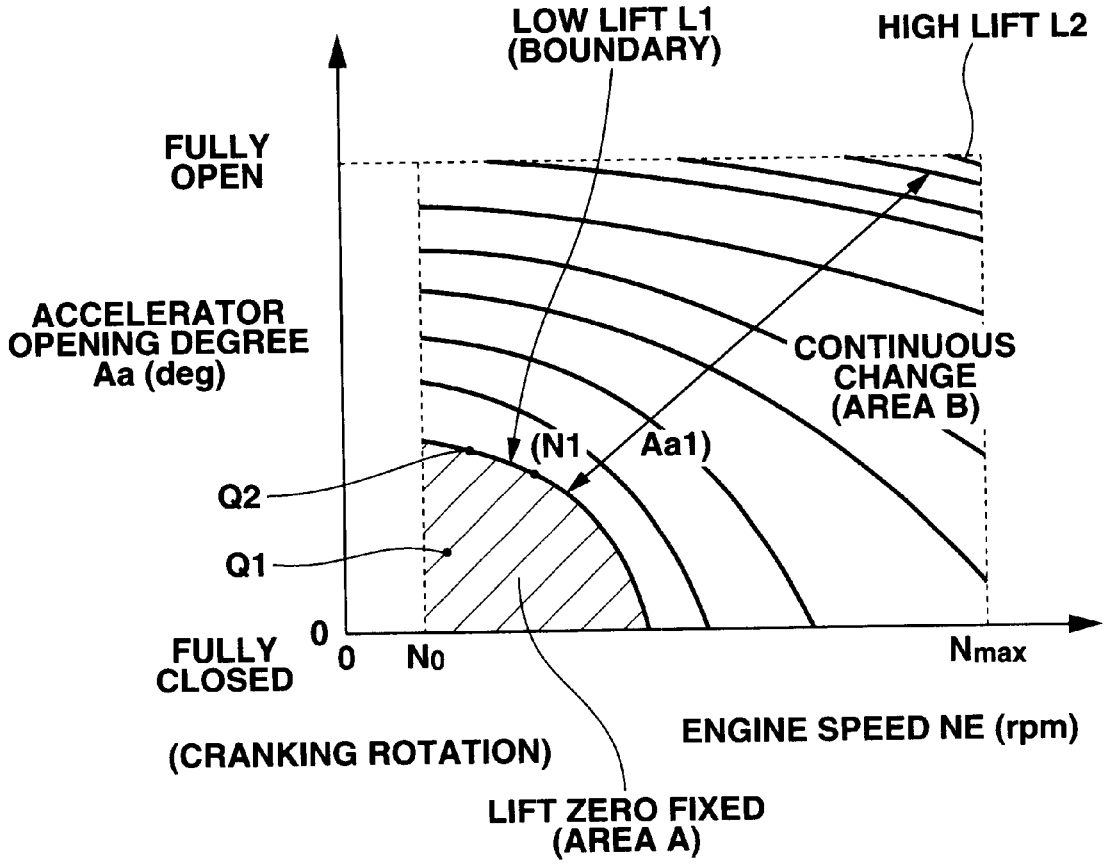
FIG. 11 is a lift control map illustrating the range from an area of zero lift fixed to a continuously variable area of low lift to high lift.

Referring to FIG. 11, the fact that the valve-lift amount passes from zero to L1 in an instant will be described in the concrete in accordance with a lift control map. In FIG. 11, an x-axis designates an engine speed NE (rpm), and a y-axis designates an accelerator opening degree Aa (deg) corresponding to an engine load. The engine speed NE is given from a cranking speed $N_0$ to an allowable maximum speed Nmax, and the accelerator opening degree Aa is given from full closing to full opening of the accelerator. It is noted that the y-axis corresponding to the engine load may provide a throttle-valve opening degree, an intake-air amount, or an intake-pipe internal pressure in place of the accelerator opening degree.

There is a boundary from the low-rotation and medium-load range to the medium-rotation and low-load range, at which the valve-lift amount passes from zero to the low lift L1. The low-rotation and low-load side of the boundary is an area A wherein the valve-lift amount is fixed to zero lift. The high-rotation and high-load side of the boundary is an area B wherein the valve-lift amount is changed continuously with an increase in engine speed or load. Thus, the boundary shows a limit between the area A or an area of zero lift fixed and the area B or an area of continuously variable lift.

Assuming, for example, that actual engine operating conditions correspond to a point Q1 in the area of zero lift fixed or area A. When depressing the accelerator pedal here, the engine operating conditions reach a point Q2 on the above boundary, at which the lift control map changes from zero to L1 in an instant. As a result, the controller 30 causes the control shaft 32 to rotate slightly counterclockwise in an instant as described above, adjusting the valve-lift amount to the low lift L1. Lift control passes merely instantaneously through a very low lift area between zero lift and the low lift L1, and selectively changes the valve-lift amount substantially between zero and the low lift L1.

Since lift control is not carried out in the very low lift area, variation can be prevented in the valve-lift amount between cylinders from occurring during very low lift due to variation in the machining accuracy of components.

Figure 12:
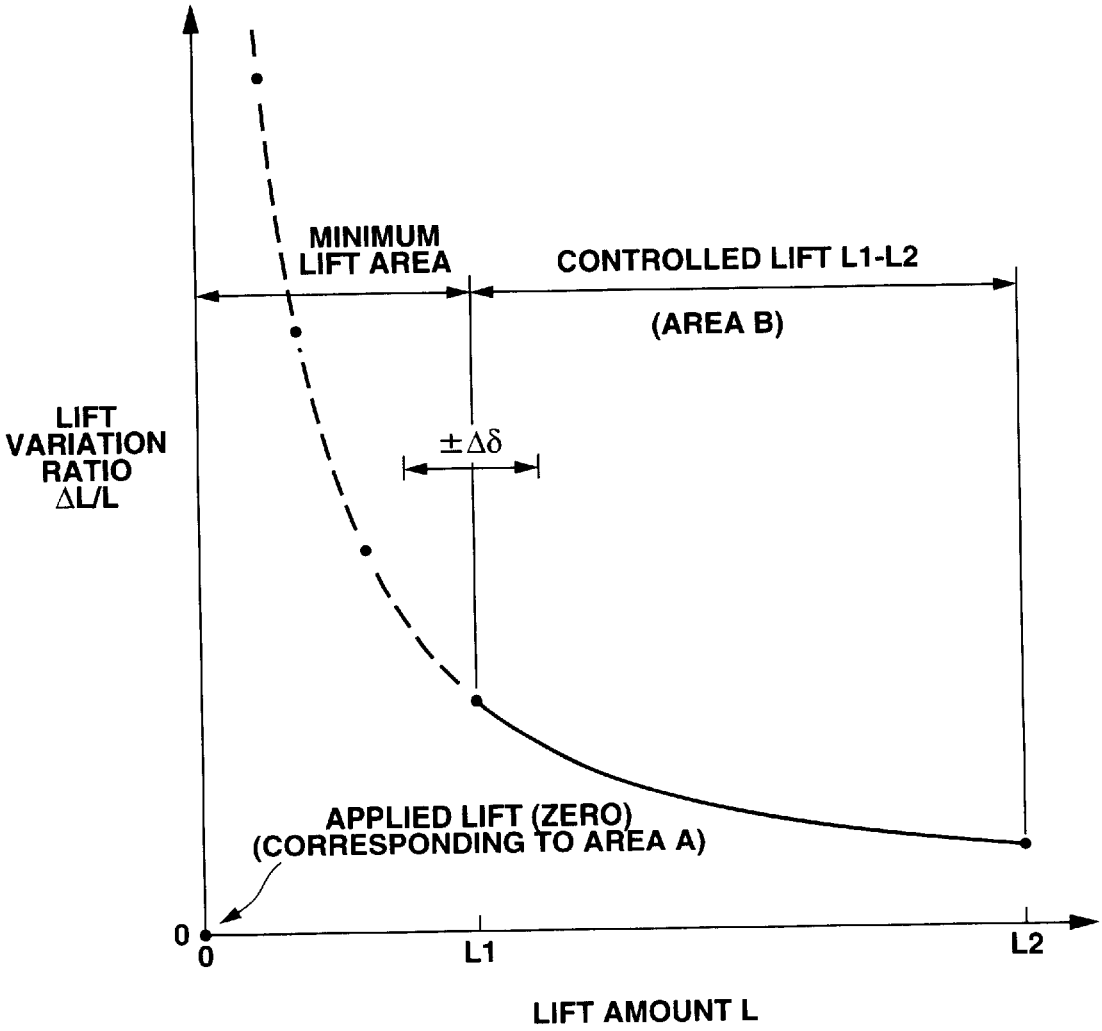
FIG. 12 is a view similar to FIG. 10, illustrating the relationship between the valve-lift amount and the lift variation ratio of the apparatus.

Referring to FIG. 12, an effect produced by lift control wherein the valve-lift amount is selectively changed between zero and the low lift L1 will be described in comparison to lift control wherein the valve-lift amount is changed continuously.

FIG. 12 shows the relationship between the valve-lift amount L and the lift variation ratio $\Delta L/L$ when the machining accuracy of components varies. The lift variation ratio $\Delta L/L$ is given as a value, for example, when the pitch length between the pinholes **25*c* at both ends of the link rod 25** of each apparatus varies by a predetermined amount.

As seen from FIG. 12, even with a reduction in the valve-lift amount L, a variation $\Delta L$ of the valve-lift amount L does not decrease in proportion to the reduced valve-lift amount L, so that the lift variation ratio $\Delta L/L$ increases with a reduction in the valve-lift amount L. It has a greater value, particularly, in the very low lift area wherein the valve-lift amount L is smaller than the low lift L1 and greater than zero, which is an example when the length of the link rods 25 varies. The lift variation ratio $\Delta L/L$ also becomes a greater value in the very low lift area when the machining or positional accuracy of other portions varies, such as the rocker arm 23, the driving shaft 13, etc. This causes greater variation in the intake-air charging efficiency and gas flow conditions between cylinders of a particular cylinder group, resulting in unstable engine performance.

However, variation in the valve-lift amount L can be prevented from occurring with the valve-lift amount being set to zero lift and not to very low lift. This is due to the fact that a valve clearance is held between the lower face **16*b* of the valve lifter 16** and the upper end face of the valve, which ensures preservation of zero lift.

In the first embodiment, since lift control is not carried out in the very low lift area wherein the lift variation ratio $\Delta L/L$ is greater, variation is restrained in the intake-air charging efficiency and gas flow conditions between cylinders of a particular cylinder group.

Further, in the first embodiment, switching from zero lift to the low lift L1 and vice versa can smoothly be carried out by the operating mechanism 10. Specifically, the control shaft 32 transiently passes at the intermediate rotated position of very low lift during rotation from the rotated position of zero lift to that of the low lift L1, enabling a full restraint of occurrence of torque shock.

Figure 8A:
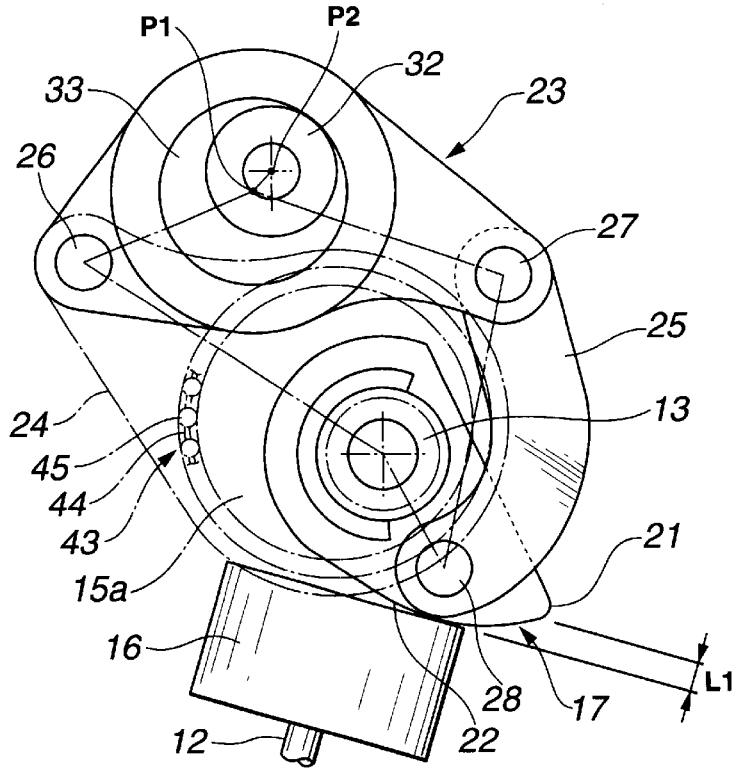
FIG. 8A is a view similar to FIGS. 7A–7B, showing the intake valve open when the valve has low lift.
Figure 8B:
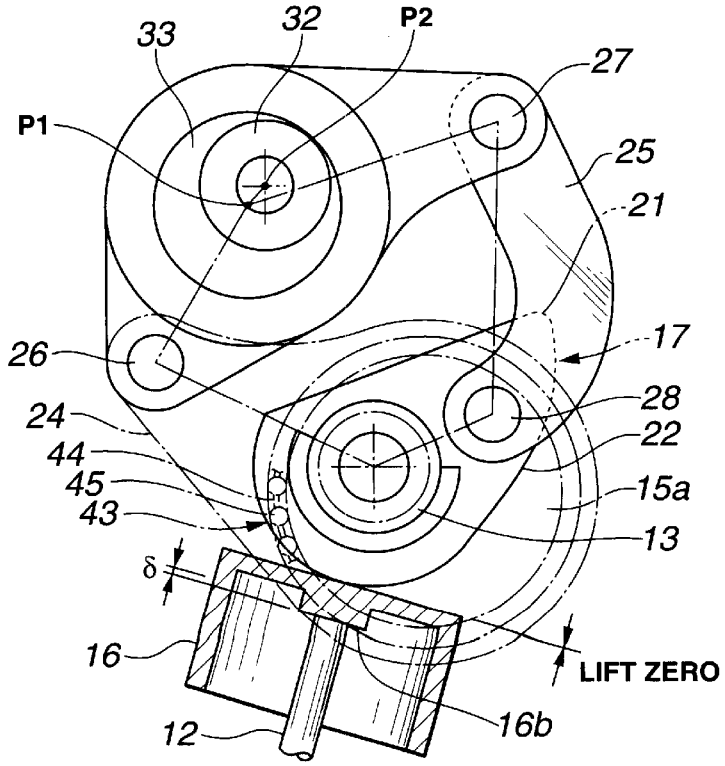
FIG. 8B is a view similar to FIG. 8B, showing the intake valve closed.

Furthermore, in the first embodiment, the amount of the low lift L1 is more than twice as large as the set value $\delta$ of the valve clearance as seen in FIGS. 8A–8B.

The lift variation ratio $\Delta L/L$ is calculated in excluding variation in the valve clearance, change thereof with time, etc. Actually, the valve clearance includes not only such errors, but undergoes another change with time due to wear of a valve shaft end or formation of a deposit. Those errors produce a variation $\Delta\delta$ in the valve clearance, which changes $\Delta L$ to $\Delta L \pm \Delta\delta$, resulting in change in the lift variation ratio $\Delta L/L$ (see FIG. 12).

The valve clearance has set value $\delta$ which can prevent the valve clearance from being zero (occurrence of valve thrusting) or excessive (occurrence of noise) even with the above errors.

Specifically, the variation $\Delta\delta$ in the valve clearance is smaller than the set value $\delta$. Thus, by setting the low lift L1 to $2\delta$ or more, the actual lift amount can be $\delta$ or more, and secure the minimum lift even with variation in the valve clearance, change thereof with time, etc., enabling a restraint of unstable engine performance. It is noted that when the set value $\delta$ of the valve clearance is 0.4 mm, the low lift L1 is set to 0.8 mm or more.

On the other hand, when depressing the accelerator pedal further to pass the engine operating conditions to the high-rotation and high-load range, the control shaft 32 is rotated counterclockwise by the actuator 29 in accordance with a control signal out of the controller 30. Thus, referring to FIGS. 9A–9B, this rotates the control cam 33 further counterclockwise from the position as shown in FIGS. 8A–8B to move the axis P1 (thick portion 33*a*) of the control cam 33 downward. As a result, the rocker arm 23 is moved in its entirety in the direction of the driving shaft 13 or downward, so that the first arm 23*b* pushes the cam nose 21 of the VO cam 17 downward through the link rod 25, rotating the VO cam 17 in its entirety clockwise by a predetermined amount.

Figure 9A:
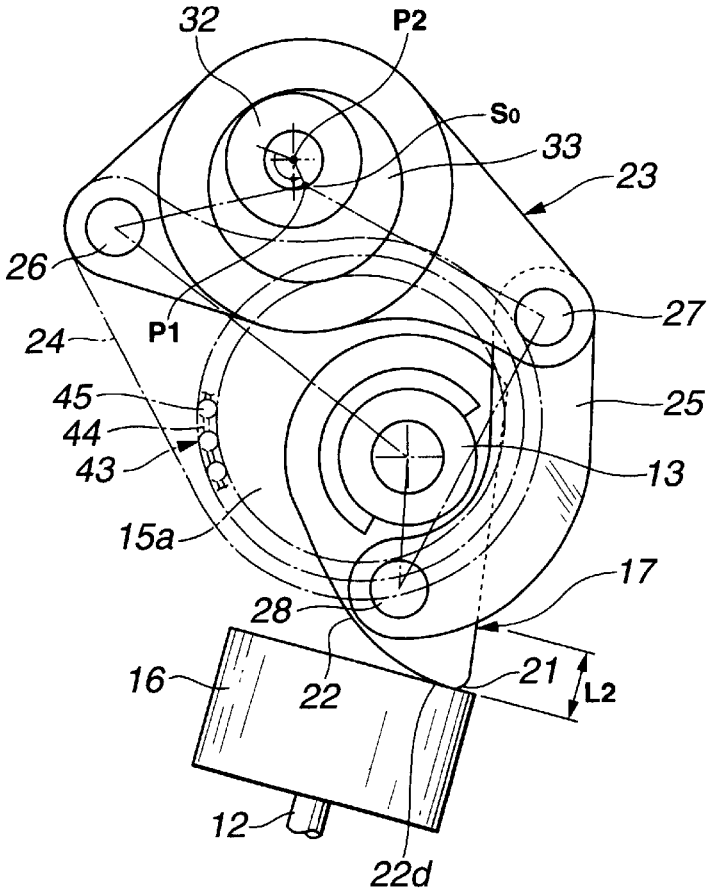
FIG. 9A is a view similar to FIG. 8B, showing the intake valve open when the valve has high lift.
Figure 9B:
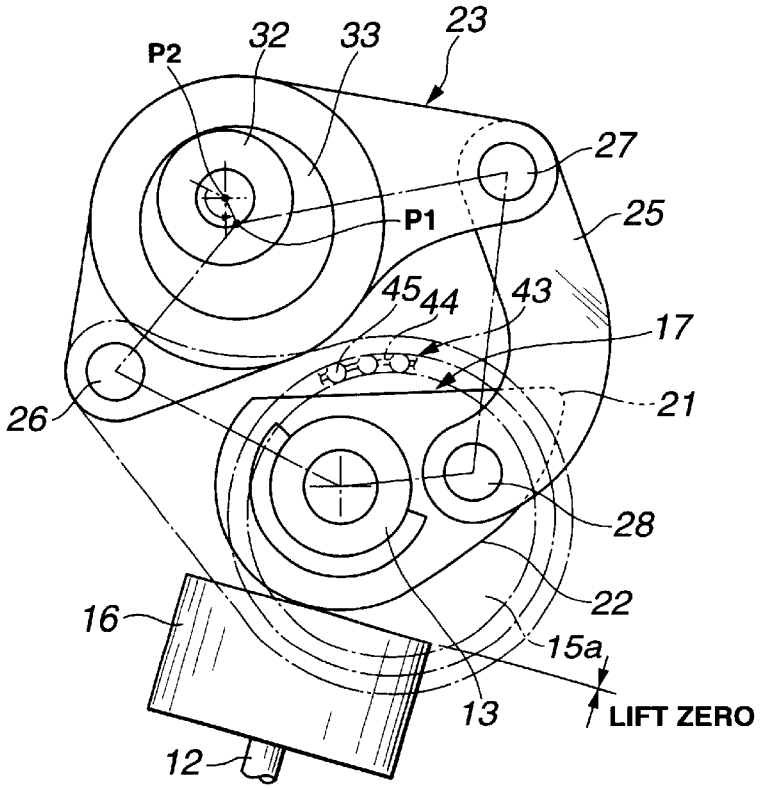
FIG. 9B is a view similar to FIG. 9A, showing the intake valve closed.

Therefore, the position of contact of the cam face 22 of the VO cam 17 with respect to the top face 16*a* of the valve lifter 16 is moved rightward or in the direction of the lift portion 22*d* as shown in FIG. 9A. This rotates the crank cam 15 as shown in FIG. 9A to push the first arm 23*a* of the rocker arm 23 through the crank arm 24, obtaining a larger lift L2 with respect to the valve lifter 16.

Thus, the valve-lift characteristic is greater in the high-rotation and high-load range than in the low-rotation and low-load range, so that the valve-lift amount L has a greater value L2 as shown in FIG. 10. This results in advanced opening timing and delayed closed timing of each intake valve 12, obtaining improved intake-air charging efficiency, allowing achievement of sufficient engine output.

Moreover, since variation in the valve-lift amount L is carried out continuously from the low-rotation and low-load range to the high-rotation and high-load range (L1 to L2), the valve lift can be controlled continuously accurately in accordance with engine operating conditions, i.e. actual engine speed and load condition. This allows achievement of the maximum engine performance such as engine torque in any engine operating condition. Moreover, in the lift range from L1 to L2, variation in the intake-air amount or the like does not occur between the cylinders as seen from FIG. 12.

When the valve-lift amount L of particular cylinders is fixed to zero lift, the valve-lift amount of the other cylinders than the particular cylinders is fixed to the low lift L1, whereas when the former is controlled in the range from L1 to L2, the latter is controlled in the same range. Specifically, the minimum lift of particular cylinders except zero lift is set to be equal to the minimum lift of the other cylinders. Thus, immediately after switching to all cylinder operation, there is no lift difference between the cylinders, producing no difference in intake-air charging efficiency between the cylinders.

Figure 13:
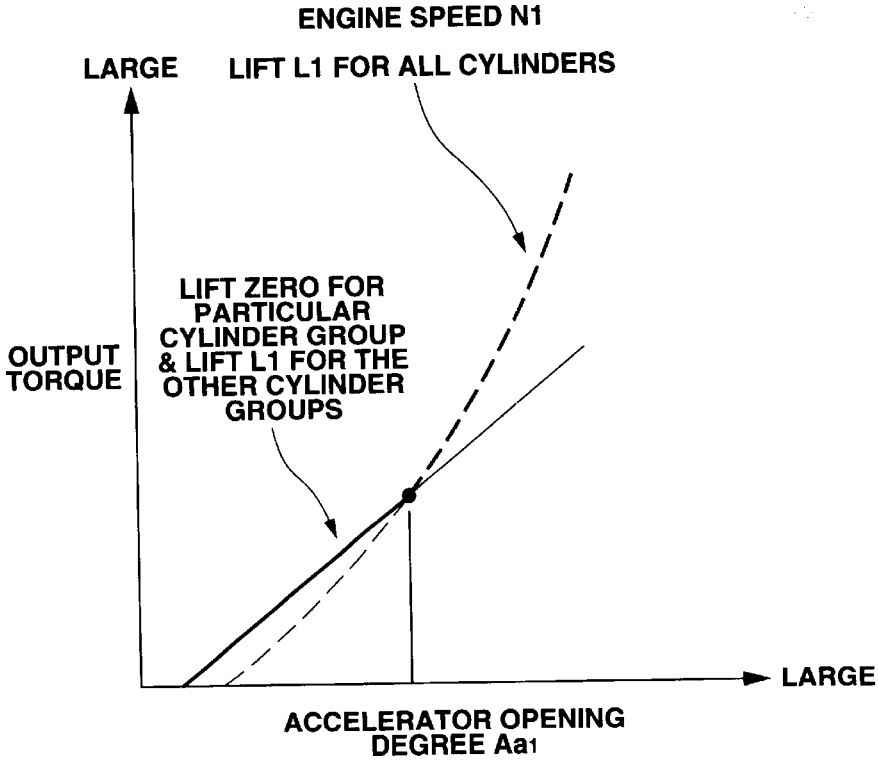
FIG. 13 is a view similar to FIG. 12, showing a second embodiment of the present invention.

FIG. 13 shows a second embodiment of the present invention wherein a set value of the low lift L1 is changed so that the low lift L1 at a point with the engine speed NE=N1 (rpm) and the accelerator opening Aa=Aa1 (deg) in the lift control map as illustrated in FIG. 11 is set to a value such that output torque at zero lift for intake valves of particular cylinders and the low lift L1 for intake valves of the other cylinders is roughly equal to output torque at the low lift L1 for intake valves of all cylinders. This allows a restraint of occurrence of torque shock when the valve lift of particular cylinders is switched from the zero lift to the low lift L1.

Specifically, output torque in the operating range with zero lift for particular cylinders with the accelerator fully open is of course smaller than that in the operating range with the low lift L1 for all cylinders. This is due to the fact that since a throttle valve is fully open when the accelerator is fully open, contraction of intake air hardly occurs at this portion, but mainly appears at intake valves, which results in reduced intake-air amount in terms of the whole of the multiple cylinder engine when the valve-lift amount of particular cylinders is set to zero lift. However, the difference between the two torques is smaller as an engine load is lower or the accelerator opening degree is smaller. When the accelerator opening degree reaches a certain value, the two torques are equal to each other, and when the accelerator opening degree becomes further smaller, the output torque with zero lift becomes higher than that with the low lift L1. This is due to the fact that as the accelerator opening degree is smaller, contraction of intake air carried out by the throttle valve is dominant, and the effect of the valve lift is smaller. With zero lift, the combustion efficiency becomes higher, and driving friction of a valve gear becomes smaller, so that greater work is possible with respect to the same intake-air amount, resulting in higher output torque with zero lift.

Figure 14:
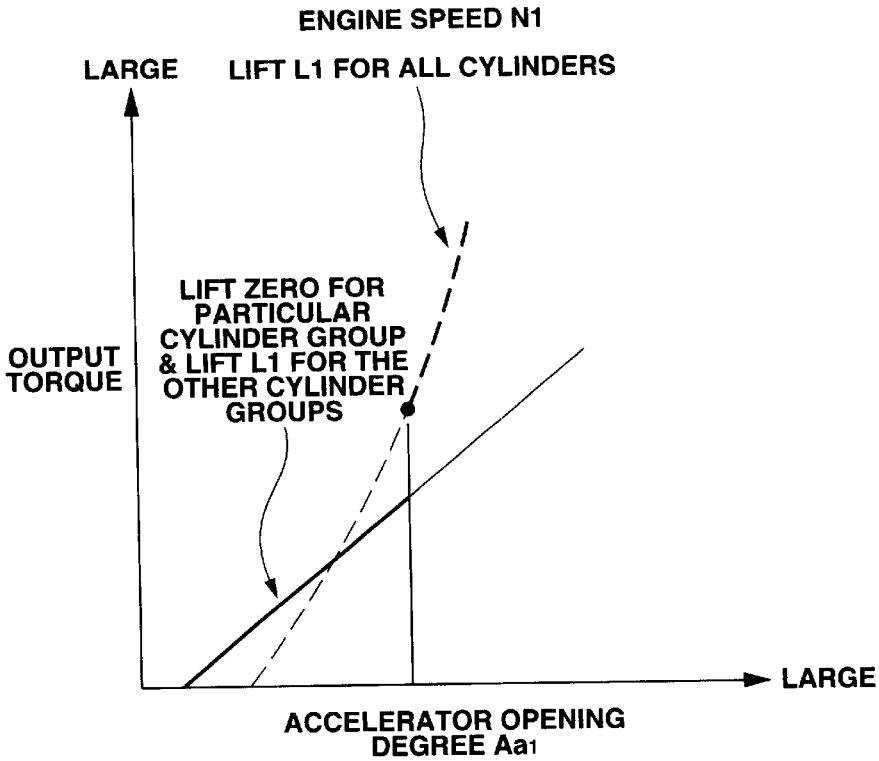
FIG. 14 is a view similar to FIG. 13, showing a third embodiment of the present invention.

FIG. 14 shows a third embodiment of the present invention wherein a set value of the low lift L1 is changed further. Specifically, in the lift control map as illustrated in FIG. 11, the low lift L1 is set to a value such that output torque at the low lift L1 for all cylinders is greater than that at zero lift for particular cylinders and the low lift L1 for the other cylinders. Thus, when the valve-lift amount is switched from zero lift to the low lift L1, increased output torque is obtained, improving the vehicular acceleration performance. This results in increased applicable range of zero lift, i.e. possible setting of the boundary on the high load side, also obtaining improved fuel consumption.

Figure 15:
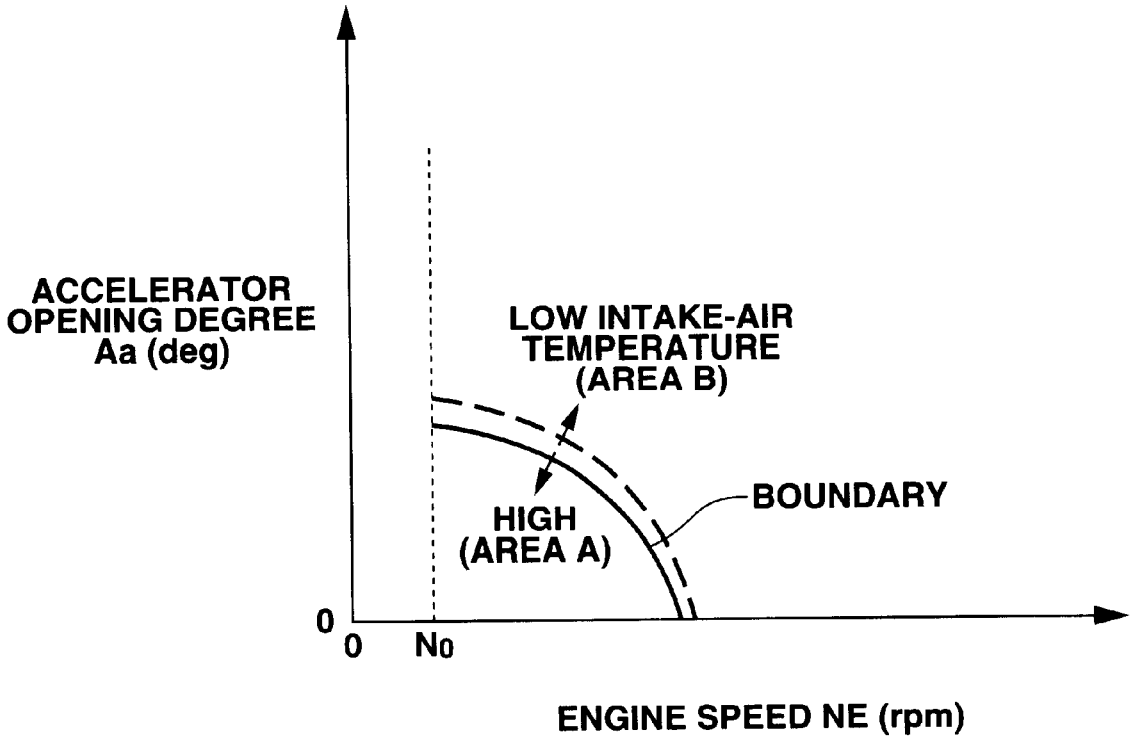
FIG. 15 is a view similar to FIG. 14, showing a fourth embodiment of the present invention.

FIG. 15 shows a fourth embodiment of the present invention wherein the boundary is changed in accordance with engine operating conditions, i.e. the intake-air temperature. Specifically, when the intake-air temperature is higher than a predetermined temperature, the boundary is changed to the side of zero lift or the side of the area A, whereas when the intake-air temperature is lower than the predetermined temperature, the boundary is changed to the side of high lift or the side of the area B.

As is well known, as the intake-air temperature falls, the density of intake mixture increases generally, improving the mixture charging efficiency, resulting in improved engine torque. Therefore, by moving the boundary to the side of the area B as in the illustrative embodiment, the operating range with zero lift can be enlarged in the high-rotation and high-load direction. This results in enlarged operating range with zero lift, thus obtaining improved fuel consumption with necessary torque secured.

Figure 16:
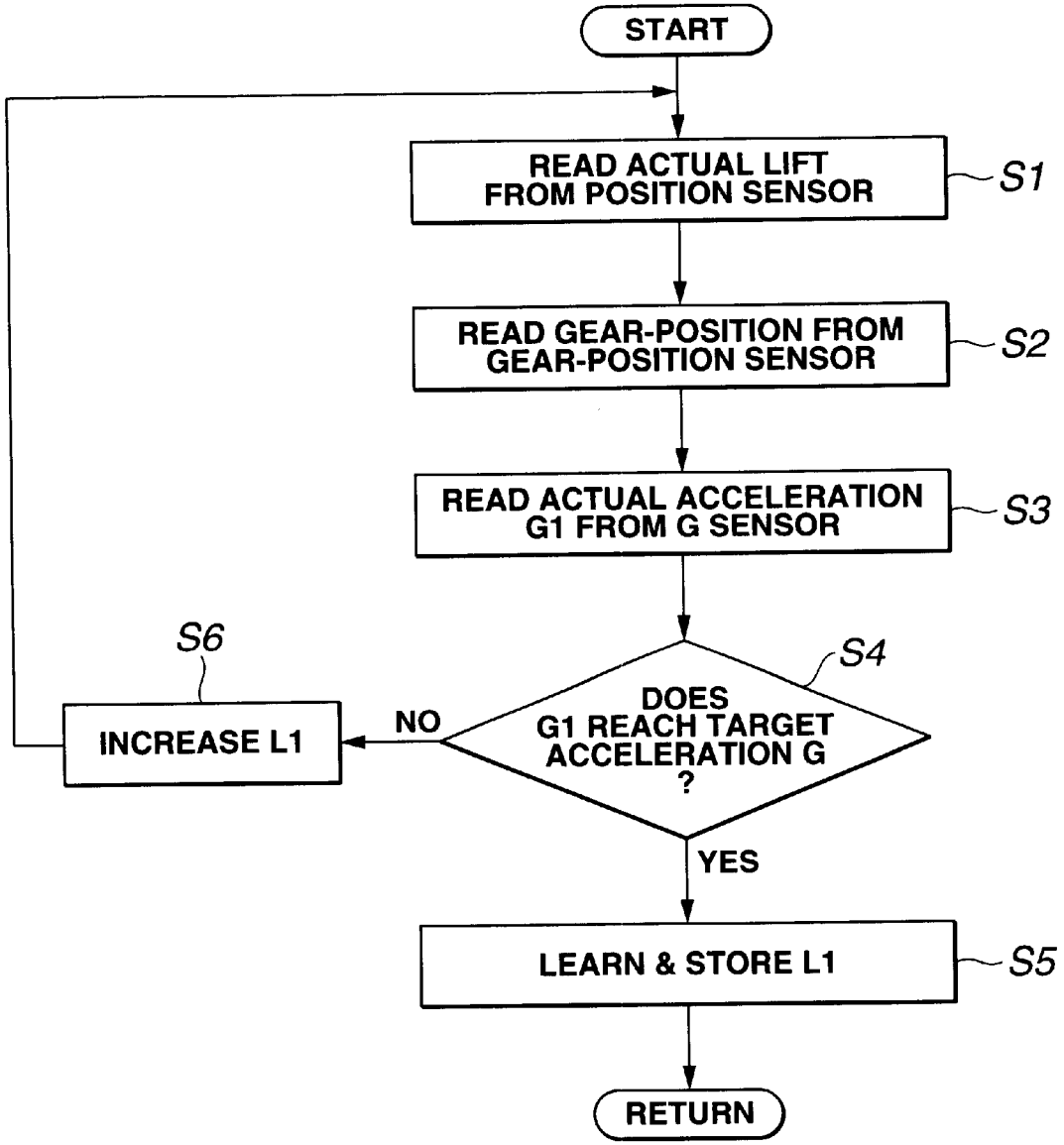
FIG. 16 is a flowchart illustrating a fifth embodiment of the present invention.

FIG. 16 is a flowchart illustrating a fifth embodiment of the present invention wherein the controller 30 carries out learning control of the low lift area placed on the boundary in accordance with variation in engine operating conditions.

Referring to FIG. 16, first, at a step S1, an actual valve lift is read from the position sensor, and at a step S2, an actual gear position is read from the gear-position sensor. Next, at a step S3, an actual acceleration G1 of the vehicle is read from the G sensor. At a subsequent step S4, the actual acceleration G1 is compared with a target acceleration G obtained in accordance with engine torque estimated out of information such as the actual valve lift and accelerator opening degree and the gear position so as to determine whether or not the actual acceleration G1 reaches the target acceleration G. If it is determined that the actual acceleration G1 reaches the target acceleration G, flow proceeds to a step S5 where the low lift L1 is learned and stored in a storage in the controller 30.

On the other hand, if it is determined that the actual acceleration G1 fails to reach the target acceleration G, flow proceeds to a step S6 where the low lift L1 is increased, which is the minimum lift when excluding zero lift. This allows the valve-lift amount L except zero lift to be increased in a relative way, improving the actual acceleration G1. And the valve-lift amount L is increased up to a given value of the low lift L1 at which the actual acceleration G1 corresponds to the target acceleration G, which is learned and stored in the storage.

Learning control is always carried out in such a way with regard to the low lift L1, so that lowering of the vehicular performance can be prevented even if friction of a vehicle or a valve gear is increased with time.

Figure 17:
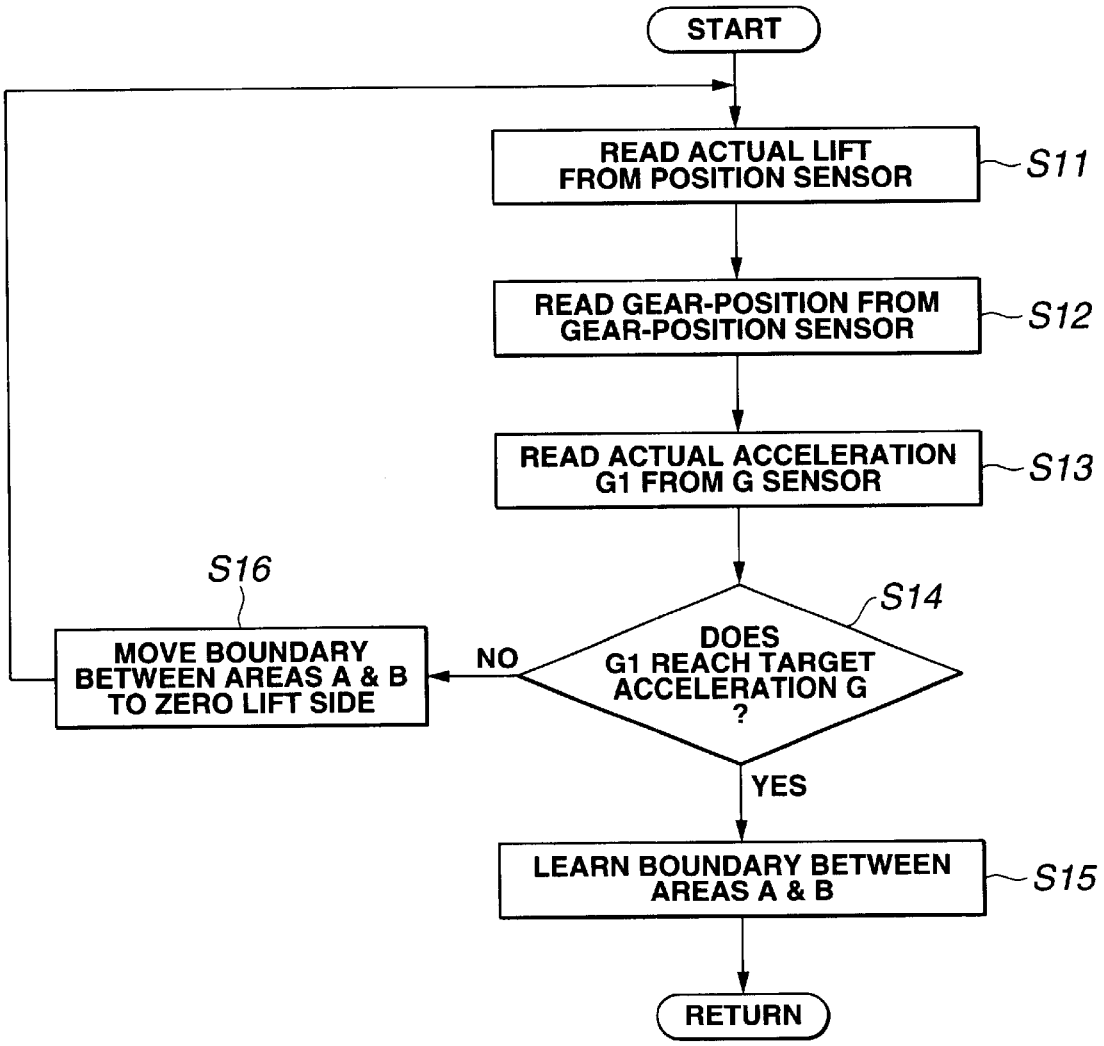
FIG. 17 is a view similar to FIG. 16, illustrating a sixth embodiment of the present invention.

FIG. 17 is a flowchart illustrating a sixth embodiment of the present invention. In the fifth embodiment, learning is carried out with regard to the low lift L1, whereas in the sixth embodiment, the boundary between the area A and the area B is learned to produce the same effect.

Referring to FIG. 17, processing from a step S11 to a step S14 is similar to that from the step S1 to the step S4 as shown in FIG. 16. At the step S14, if it is determined that the actual acceleration G1 reaches the target acceleration G, flow proceeds to a step S15 where the boundary is learned and stored in the storage in the controller 30. On the other hand, if it is determined that the actual acceleration G1 fails to reach the target acceleration G, flow proceeds to a step S16 where the boundary is moved to the side of zero lift. This allows the valve-lift amount L to be changed in the low-rotation and low-load range, improving the actual acceleration G1. And the valve-lift amount L is increased up to a given value on the boundary at which the actual acceleration G1 corresponds to the target acceleration G, which is learned and stored in the storage.

Figure 18:
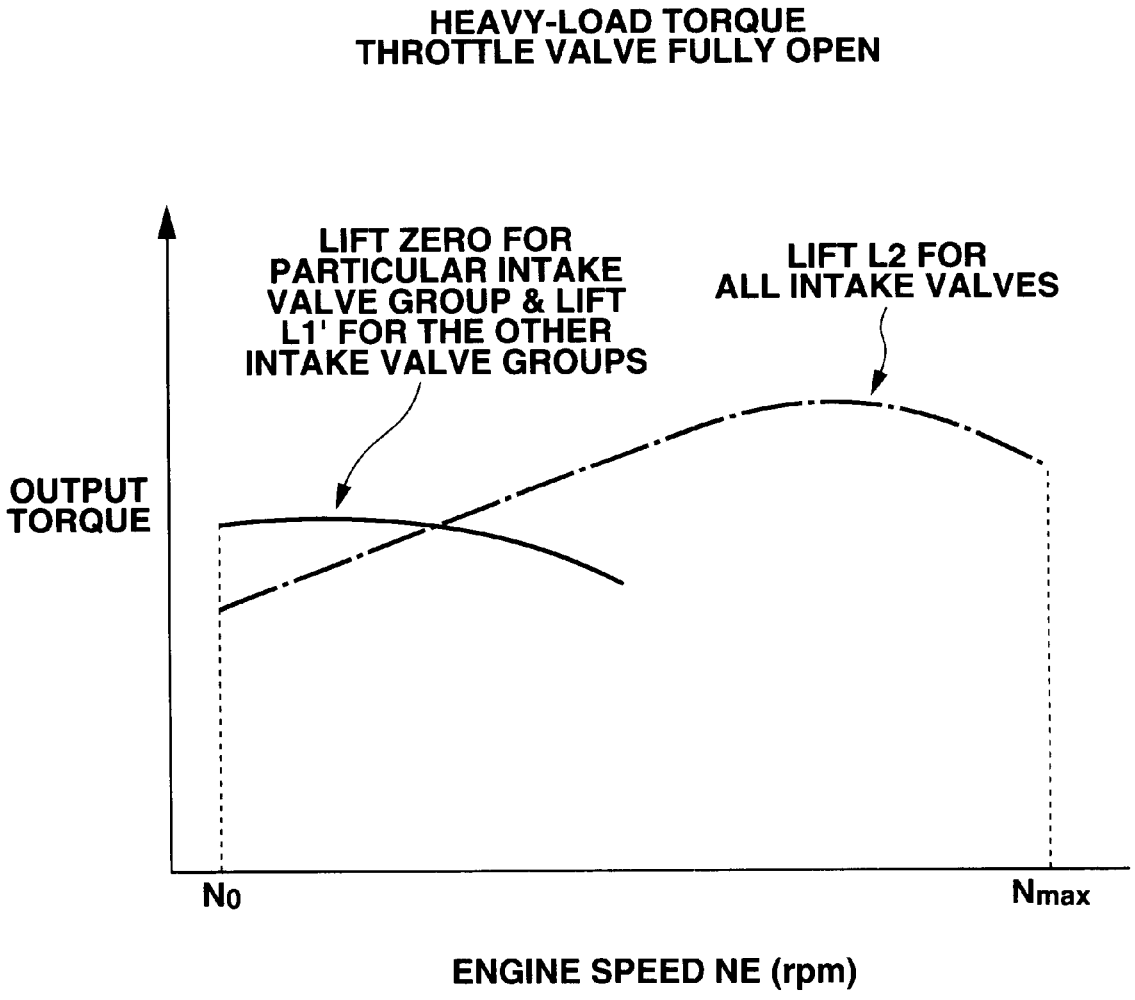
FIG. 18 is a view similar to FIG. 15, showing a seventh embodiment of the present invention.

FIG. 18 shows a seventh embodiment of the present invention wherein a set value of the low lift L1 is set to a reasonably small value between zero lift and the high lift L2.

In the aforementioned embodiments, in the event that the actuator 29 cannot produce torque due to, e.g. its failure such as disconnection, the valve-lift amount L of the intake valves 12 of particular cylinders is fixed to zero lift by a biasing force of a valve spring, whereas the valve-lift amount of the intake valves of the other cylinders is fixed to the low lift L1. This may bring a lack of engine torque, resulting in greatly deteriorated operating performance in the ordinary low-rotation range.

On the other hand, in the seventh embodiment, the valve-lift amount L of the intake valves of particular cylinders is set to zero lift, whereas the valve-lift amount of the intake valves of the other cylinders is set to a reasonably small lift L1', obtaining the high-load output torque characteristic as illustrated in FIG. 18. Specifically, when widely depressing the accelerator pedal to achieve full opening of the accelerator, and the valve-lift amount L of all cylinders has a predetermined larger value L2, output torque varies along a curve as illustrated by one-dot chain line in FIG. 18, obtaining high output torque in the high-rotation range due to high lift and wide operating angle. However, in the low-rotation range, as a result of high lift and wide operating angle, mixture once inhaled in cylinders is discharged into the intake pipe due to larger valve lift after the piston bottom dead center and lagged closing timing of the intake valves, lowering the mixture charging efficiency, resulting in certain torque reduction.

On the other hand, when setting a set value of the low lift L1 to the reasonably small value L1', a discharge of mixture during low rotation is smaller even with smaller number of actuated intake valves, so that torque in the low-rotation and high-load range is greater than that when the valve-lift amount L of all intake valves has the maximum lift L2 as illustrated by fully drawn line in FIG. 18.

In the seventh embodiment, a set value of the low lift L1 is set to the reasonably small value L1' in such a way, so that even if the valve-lift amount L of particular intake valves 12 is fixed to zero lift, and the valve-lift amount of the other intake valves is fixed to the low lift L1 due to failure of the actuator 29, torque in the low-rotation and high-load range can be greater than that obtained by fixing the valve-lift amount of all intake valves to the maximum lift L2, preventing greatly deteriorated operating performance in the ordinary low-rotation range due to lack of engine torque.

Having described the present invention with regard to the illustrative embodiments, it is noted that the present invention is not limited thereto, and various changes and modifications can be made without departing from the scope of the present invention. By way of example, in the illustrative embodiments, the present invention is applied to a two-valve-stop engine so called wherein the intake valves for each cylinder have both zero lift. The present invention is not limited thereto, and it is of course applicable to a one-valve-stop engine so called wherein one of the two intake valves has zero lift to enhance swirl in the cylinder for improved fuel consumption.

The entire contents of Japanese Patent Application 11-362086 are incorporated hereby by reference.

What is claimed is:

1. A variable-valve-actuation (VVA) apparatus for an internal combustion engine with valves, comprising:

an operating mechanism that changes a lift amount of the valves; and a microcomputer-based controller that controls said operating mechanism to change said lift amount in accordance with operating conditions of the engine, a first portion of said lift amount between a predetermined high value and a predetermined low value being changed continuously, a second portion of said lift amount between said predetermined low value and zero being changed with one of said predetermined low value and zero selected.

2. The VVA apparatus as claimed in claim 1, wherein said predetermined low value of said lift amount is more than twice as large as a clearance of the valves.

3. The VVA apparatus as claimed in claim 1, wherein said controller is provided with a map used for controlling said lift amount, said map comprising first and second areas and a boundary between said first and second areas.

4. The VVA apparatus as claimed in claim 3, wherein said first area of said map is such that said lift amount of the valves is fixed to zero, and said second area of said map is such that said lift amount of the valves is changed continuously from said predetermined low value to said predetermined high value.

5. The VVA apparatus as claimed in claim 3, wherein said first area of said map is such that said lift amount of particular valves is fixed to said predetermined low value and said lift amount of the other valves is fixed to said predetermined low value, and said second area of said map is such that said lift amount of all valves is changed continuously from said predetermined low value to said predetermined high value.

6. The VVA apparatus as claimed in claim 5, wherein on said boundary between said first and second areas, output torque of the engine when said lift amount of said all valves is fixed to said predetermined low value is approximately equal to that of the engine when said lift amount of said particular valves is fixed to zero and said lift amount of said the other valves is fixed to said predetermined low value.

7. The VVA apparatus as claimed in claim 5, wherein on said boundary between said first and second areas, output torque of the engine when said lift amount of said all valves is fixed to said predetermined low value is greater than that of the engine when said lift amount of said particular valves is fixed to zero and said lift amount of said the other valves is fixed to said predetermined low value.

8. The VVA apparatus as claimed in claim 5, wherein in a low-rotation and high-load range of the engine, output torque of the engine when said lift amount of said particular valves is fixed to zero and said lift amount of said the other valves is fixed to said predetermined low value is greater than that of the engine when said lift amount of said all valves is fixed to said predetermined high value.

9. The VVA apparatus as claimed in claim 3, wherein said boundary between said first and second areas is moved in accordance with said operating conditions of the engine.

10. The VVA apparatus as claimed in claim 9, wherein said boundary between said first and second areas is moved to a side of said predetermined high value when a temperature of air inhaled into a combustion chamber is lower than a predetermined value.

11. The VVA apparatus as claimed in claim 9, wherein said controller controls said boundary between said first and second areas and said predetermined low value on said boundary in accordance with a result of learning.

12. The VVA apparatus as claimed in claim 1, wherein said operating mechanism comprises a driving shaft rotated by a crankshaft of the engine and provided with a crank cam at an outer periphery thereof, a valve operating (VO) cam coming in slide contact with a top face of a valve lifter disposed at an upper end of each valve to open and close it, a transmission mechanism connected between said crank cam and said VO cam, and an alteration mechanism for variably controlling an operation position of said transmission mechanism to change a position of contact of said VO cam with respect to said top face of said valve lifter.

13. A variable-valve-actuation (VVA) apparatus for an internal combustion engine with valves, comprising:

an operating mechanism that changes a lift amount of the valves, said operating mechanism comprising a driving shaft rotated by a crankshaft of the engine and provided with a crank cam at an outer periphery thereof, a valve operating (VO) cam coming in slide contact with a top face of a valve lifter disposed at an upper end of each valve to open and close it, a transmission mechanism connected between said crank cam and said VO cam, and an alteration mechanism for variably controlling an operation position of said transmission mechanism to change a position of contact of said VO cam with respect to said top face of said valve lifter; and a microcomputer-based controller that controls said operating mechanism to change said lift amount in accordance with operating conditions of the engine, a first portion of said lift amount between a predetermined high value and a predetermined low value being changed continuously, a second portion of said lift amount between said predetermined low value and zero being changed with one of said predetermined low value and zero selected.

14. The VVA apparatus as claimed in claim 13, wherein said predetermined low value of said lift amount is more than twice as large as a clearance of the valves.

15. The VVA apparatus as claimed in claim 13, wherein said controller is provided with a map used for controlling said lift amount, said map comprising first and second areas and a boundary between said first and second areas.

16. The VVA apparatus as claimed in claim 15, wherein said first area of said map is such that said lift amount of the valves is fixed to zero, and said second area of said map is such that said lift amount of the valves is changed continuously from said predetermined low value to said predetermined high value.

17. The VVA apparatus as claimed in claim 15, wherein said first area of said map is such that said lift amount of particular valves is fixed to said predetermined low value and said lift amount of the other valves is fixed to said predetermined low value, and said second area of said map is such that said lift amount of all valves is changed continuously from said predetermined low value to said predetermined high value.

18. The VVA apparatus as claimed in claim 17, wherein on said boundary between said first and second areas, output torque of the engine when said lift amount of said all valves is fixed to said predetermined low value is approximately equal to that of the engine when said lift amount of said particular valves is fixed to zero and said lift amount of said the other valves is fixed to said predetermined low value.

19. The VVA apparatus as claimed in claim 17, wherein on said boundary between said first and second areas, output torque of the engine when said lift amount of said all valves is fixed to said predetermined low value is greater than that of the engine when said lift amount of said particular valves is fixed to zero and said lift amount of said the other valves is fixed to said predetermined low value.

20. The VVA apparatus as claimed in claim 17, wherein in a low-rotation and high-load range of the engine, output torque of the engine when said lift amount of said particular valves is fixed to zero and said lift amount of said the other valves is fixed to said predetermined low value is greater than that of the engine when said lift amount of said all valves is fixed to said predetermined high value.

21. The VVA apparatus as claimed in claim 15, wherein said boundary between said first and second areas is moved in accordance with said operating conditions of the engine.

22. The VVA apparatus as claimed in claim 21, wherein said boundary between said first and second areas is moved to a side of said predetermined high value when a temperature of air inhaled into a combustion chamber is lower than a predetermined value.

23. The VVA apparatus as claimed in claim 21, wherein said controller controls said boundary between said first and second areas and said predetermined low value on said boundary in accordance with a result of learning.

* * * * *